US011088497B2

(12) United States Patent
Hsiao et al.

(10) Patent No.: US 11,088,497 B2
(45) Date of Patent: Aug. 10, 2021

(54) RF ELECTRICAL CONNECTOR

(71) Applicants: FU DING PRECISION INDUSTRIAL (ZHENGZHOU) CO., LTD., Zhengzhou (CN); FOXCONN INTERCONNECT TECHNOLOGY LIMITED, Grand Cayman (KY)

(72) Inventors: Shih-Wei Hsiao, New Taipei (TW); Yu-San Hsiao, New Taipei (TW); Yen-Chih Chang, New Taipei (TW); Wei-Chou Lin, New Taipei (TW); Na Yang, Kunshan (CN); Meng Liu, Kunshan (CN); Xiao-Li Liu, Kunshan (CN); Wei-Hua Zhang, Kunshan (CN); Tao Shen, Kunshan (CN); Zhan-Sheng Meng, Kunshan (CN); Yu-Ke Chen, Kunshan (CN)

(73) Assignees: FU DING PRECISION INDUSTRIAL (ZHENGZHOU) CO., LTD., Zhengzhou (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 31 days.

(21) Appl. No.: 16/672,537

(22) Filed: Nov. 4, 2019

(65) Prior Publication Data

US 2020/0153175 A1 May 14, 2020

(30) Foreign Application Priority Data

Nov. 8, 2018 (CN) ..... 201811321820.5

(51) Int. Cl.
*H01R 24/64* (2011.01)
*H01R 24/54* (2011.01)
(Continued)

(52) U.S. Cl.
CPC ..... *H01R 24/64* (2013.01); *H01R 9/05* (2013.01); *H01R 13/502* (2013.01); *H01R 24/542* (2013.01); *H01R 2103/00* (2013.01)

(58) Field of Classification Search
CPC .... H01R 24/64; H01R 13/6594; H01R 12/57; H01R 24/50; H01R 13/02; H01R 13/46; H01R 24/44; H01R 43/205
See application file for complete search history.

(56) References Cited

U.S. PATENT DOCUMENTS 4,412,717 A * 11/1983 Monroe ..... H01R 9/0518 439/581
6,948,977 B1 * 9/2005 Behrent ..... H01R 24/50 439/581

(Continued)

FOREIGN PATENT DOCUMENTS

TW I539700 12/2014

*Primary Examiner* — Jean F Duverne
(74) *Attorney, Agent, or Firm* — Ming Chieh Chang; Wei Te Chung

(57) ABSTRACT

An electrical connector includes an outer conductor and an inner conductor coaxially arranged with each other with an insulator therebetween. The outer conductor includes a base and a plurality of arc protrusions formed on a rear face of the base and coaxially sharing the same circle center. The protrusions are optimally located around a peripheral region of the circle defined by the cross-section of the cylindrical contour. A metallic box includes a top wall, opposite front and rear walls and opposite two side walls. The front wall forms a plurality of arc holes coaxially arranged with regard to a common center so as to snugly receive the corresponding arc protrusions of the outer conductor, respectively.

19 Claims, 15 Drawing Sheets

(51) Int. Cl.

| | |
|---|---|
| ***H01R 13/502*** | (2006.01) |
| ***H01R 9/05*** | (2006.01) |
| *H01R 103/00* | (2006.01) |

(56) References Cited

U.S. PATENT DOCUMENTS

| | | | | |
|---|---|---|---|---|
| 8,430,675 | B2 * | 4/2013 | Hardy | H01R 24/50 439/63 |
| 8,647,128 | B2 * | 2/2014 | Sykes | H01R 24/44 439/63 |
| 9,661,776 | B2 * | 5/2017 | Rossman | H05K 7/1451 |
| 2009/0137133 | A1 * | 5/2009 | Gou | H01R 43/205 439/63 |

* cited by examiner

RF ELECTRICAL CONNECTOR

BACKGROUND OF THE DISCLOSURE

1. Field of the Disclosure

The present disclosure relates to an electrical connector, and more particularly to an RF electrical connector equipped with a metallic shell.

2. Description of Related Arts

China Patent No. CN101202397B discloses an RF (Radio Frequency) cable connector which is adapted to be mated with the electrical connector having a cylindrical contour and mounted upon the metallic shell/box. Because the bending moment occurs during mating, it is required to have a reinforced interengagement between the cylindrical outer conductor and the metallic box.

An improved electrical connector with superior interengagement between eh outer conductor and the metal box, is desired.

SUMMARY OF THE DISCLOSURE

An object of the invention is to provide an electrical connector with an outer conductor and an inner conductor coaxially arranged with each other with an insulator therebetween. The outer conductor includes a base and a plurality of arc protrusions formed on a rear face of the base and coaxially sharing the same circle center. The protrusions are optimally located around a peripheral region of the circle defined by the cross-section of the cylindrical contour. A metallic box includes a top wall, opposite front and rear walls and opposite two side walls. The front wall forms a plurality of arc holes coaxially arranged with regard to a common center so as to snugly receive the corresponding arc protrusions of the outer conductor, respectively.

Some holes and the corresponding protrusions are coupled in an interference fit while other holes and the corresponding protrusions are coupled with clearances so as to provide both rigidity and flexibility of interengagement between the outer conductor and the metal box.

Other objects, advantages and novel features of the disclosure will become more apparent from the following detailed description when taken in conjunction with the accompanying drawings.

DETAILED DESCRIPTION OF THE PREFERRED EMBODIMENT

Figure 1:
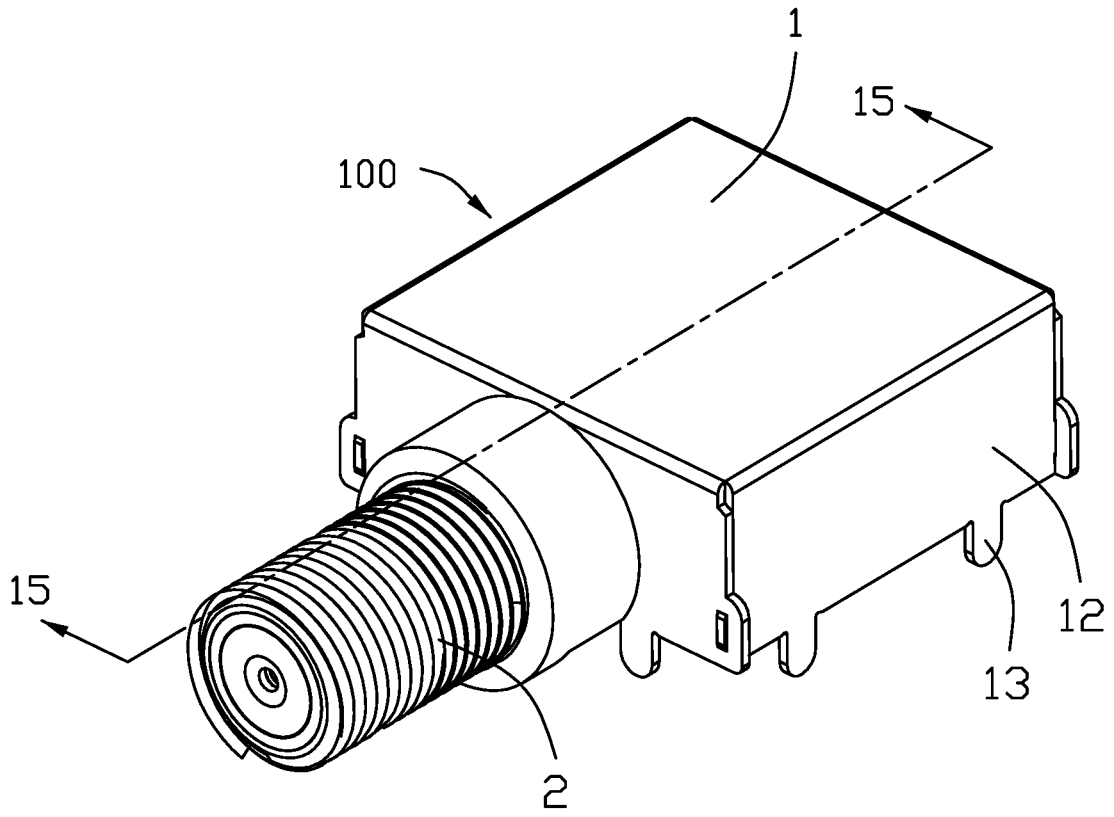
FIG. 1 is a perspective view of an electrical connector according to a first embodiment of the invention.
Figure 2:
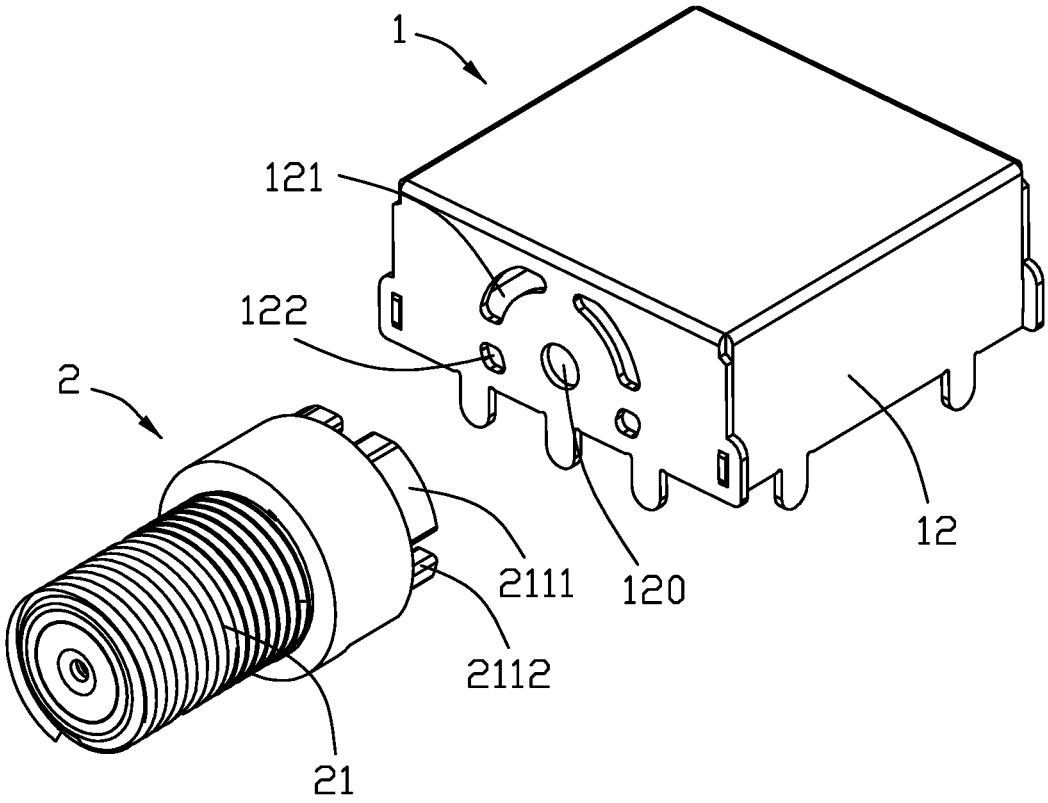
FIG. 2 is an exploded perspective view of the electrical connector of FIG. 1.
Figure 3:
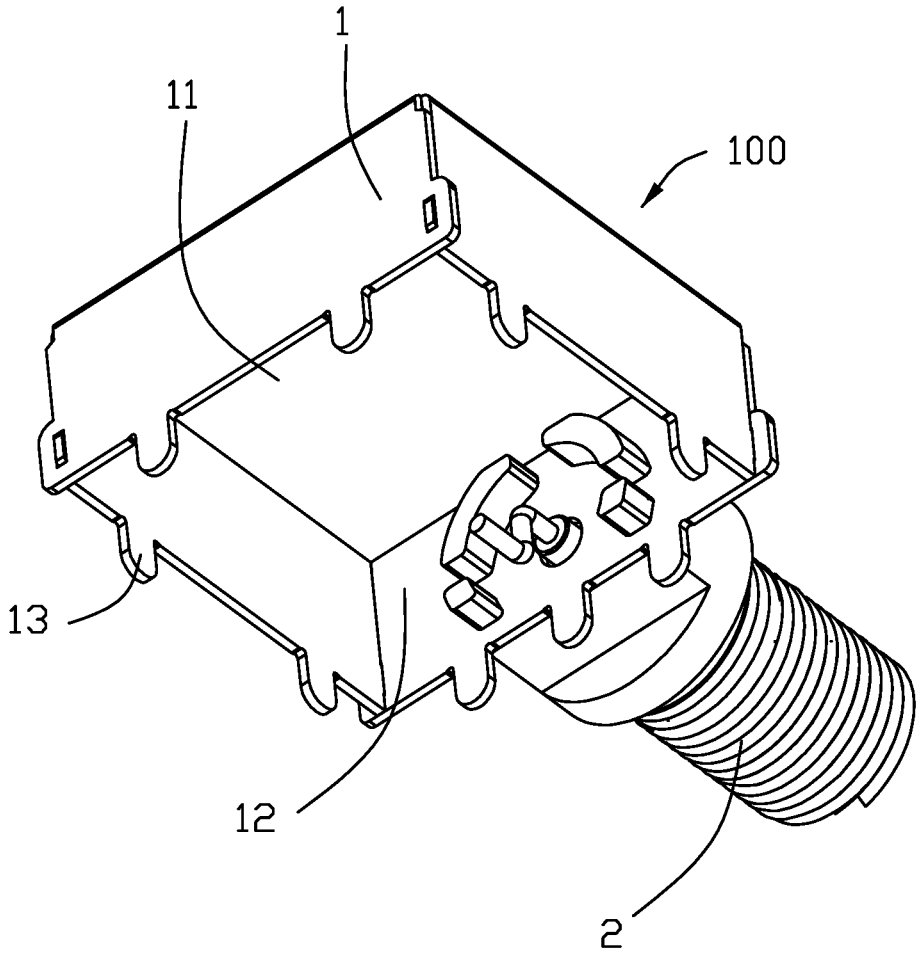
FIG. 3 is another perspective view of the electrical connector of FIG. 1.
Figure 4:
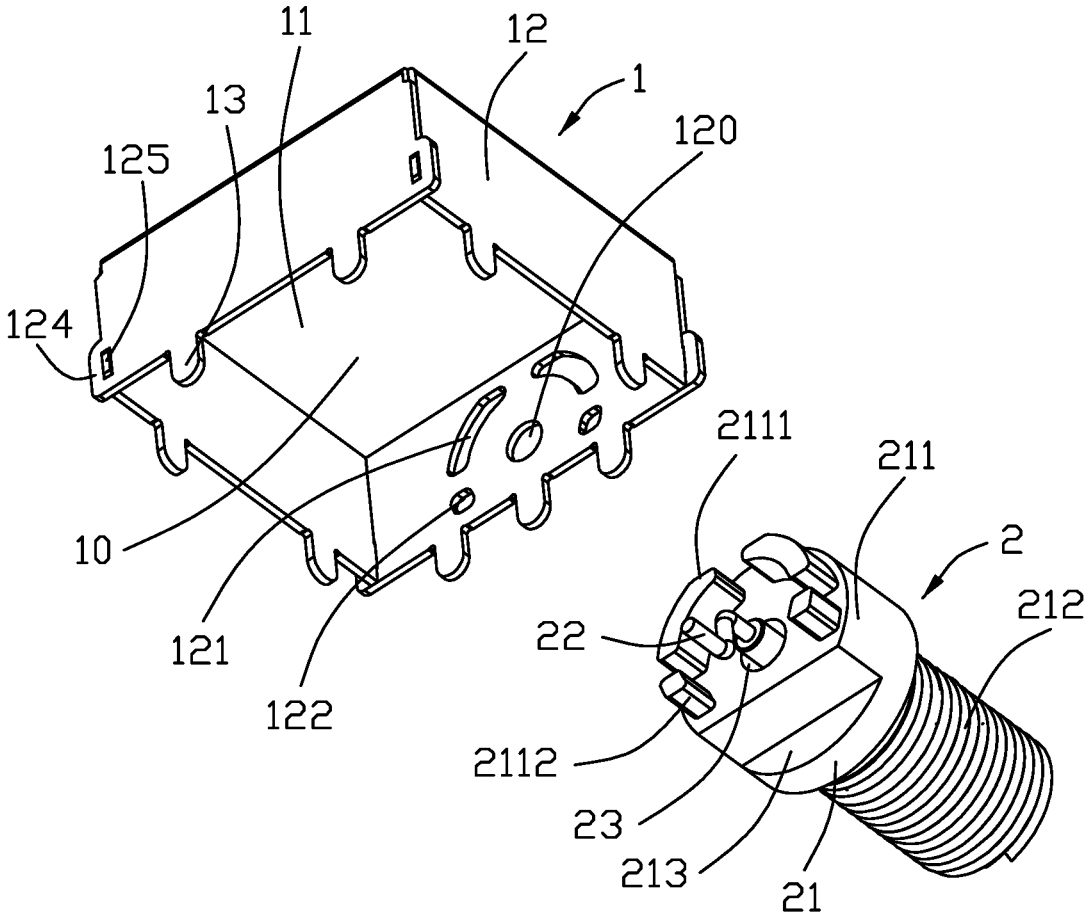
FIG. 4 is another exploded perspective view of the electrical connector of FIG. 2.
Figure 5:
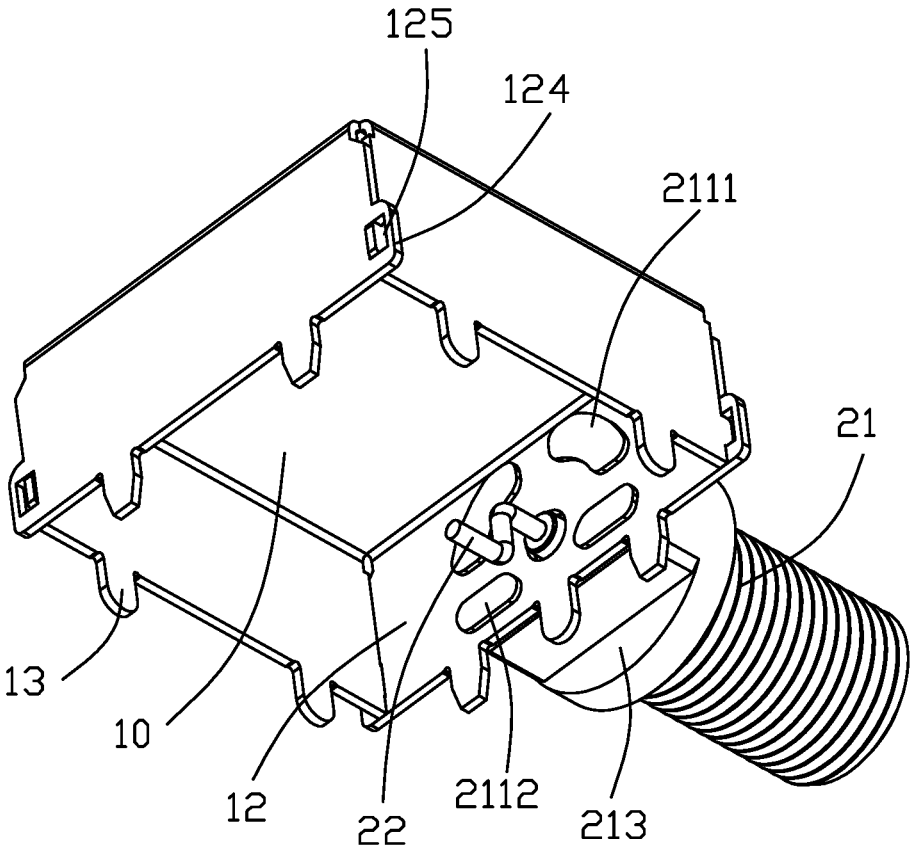
FIG. 5 is a perspective view of the electrical connector of FIG. 1 wherein the protrusions is riveted.
Figure 14:
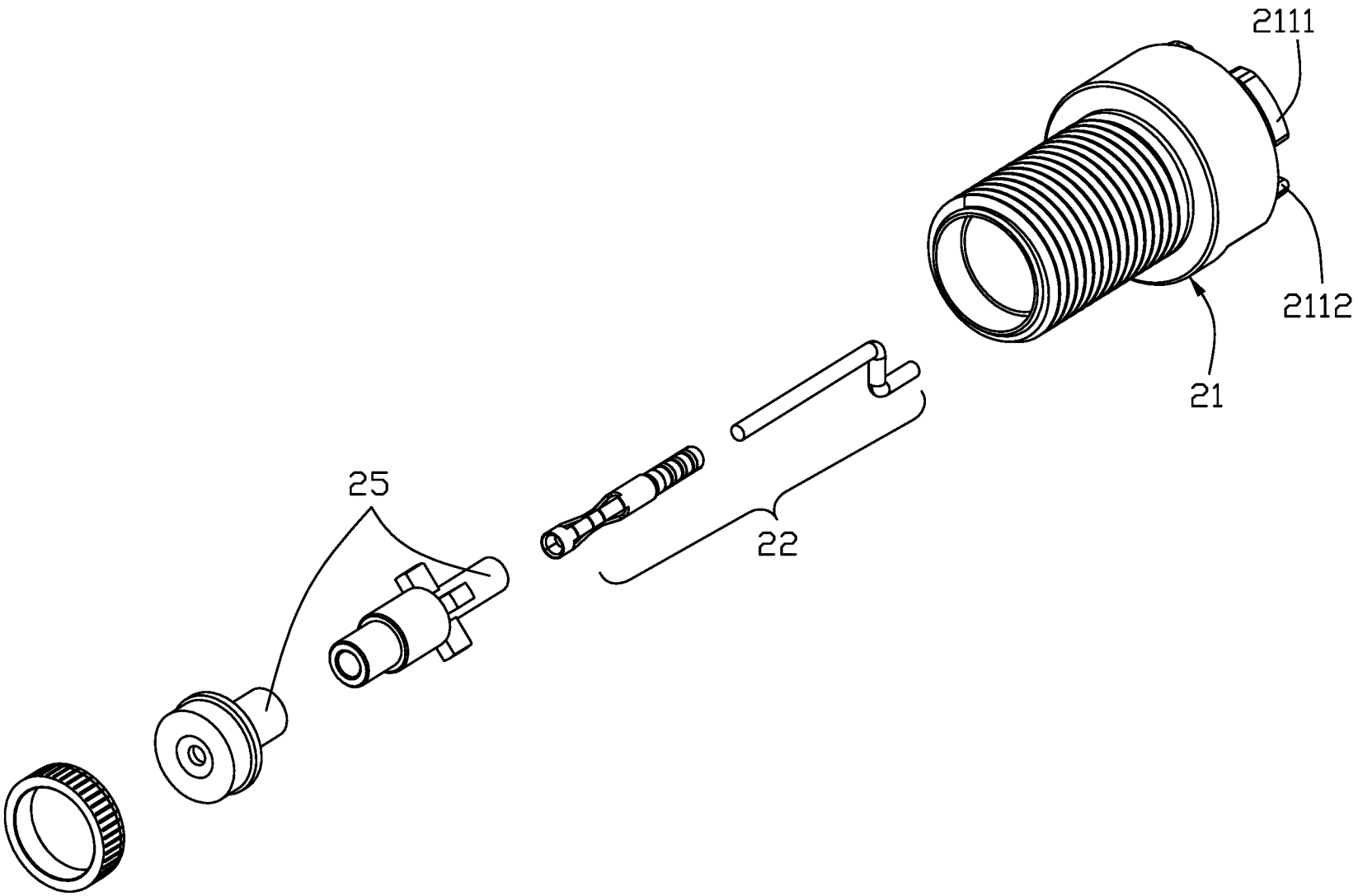
FIG. 14 is an exploded perspective view of the mating port of the electrical connector of FIG. 1.
Figure 15:
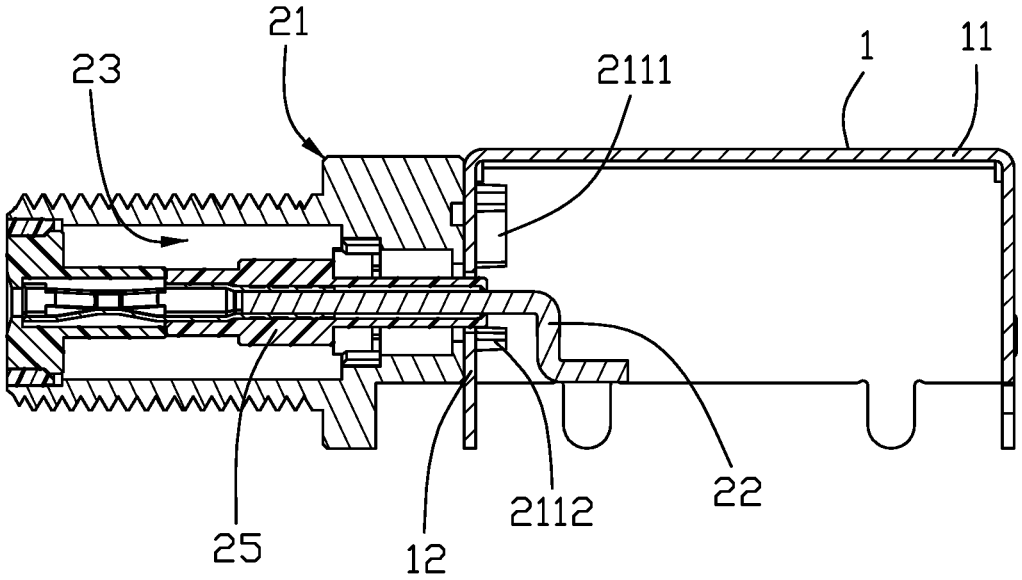
FIG. 15 is a cross-sectional view of the electrical connector of FIG. 1.

Referring to FIGS. 1-5 and 14-15, an electrical connector 100 includes a mating unit 2 and a metal box 1 secured to each other. The metal box 1 is adapted to be mounted upon a printed circuit board (not shown) as well as the mating unit 2. The metal box 1 formed by sheet metal, includes a top wall 11 and a plurality of side walls 12 downwardly extending from side edges of the top wall 11 and cooperating with the top wall 11 to commonly form a rectangular downwardly facing cavity 1. Each side wall 12 has mounting legs 13 extending downwardly from a bottom edge thereof. The front side wall 12 further forms a plurality of through holes and on center hole 120. The through holes includes a pair of first arc holes 121 and a pair of second arc holes 122 smaller than the first arc holes 121. The first arc holes 121 and the second arc holes 122 coaxially share the same center and are essentially located around a peripheral region of the corresponding circle with regard to the center hole 120, wherein the first arc hole 121 is longer than the second arc hole 122. Two side walls 12 include assembling holes 125, and the other two side walls 12 include corresponding assembling protrusions 124 to be received within the corresponding assembling holes 125 for assembling the side walls together. In this embodiment, the center hole 120 is essentially located at a lower portion of the front side wall 12 instead of the middle level.

The mating unit 2 includes an outer/periphery conductor 21 having a cylindrical contour, and an inner/center conductor 22 coaxially arranged within the outer conductor 21 with a front mating part for mating with a plug connector, and a rear mounting part for mounting to the printed circuit board. A tubular insulator 25 is located between the inner conductor 22 and the outer conductor 21. The outer conductor 21 includes a base 211, a mating section 212 forwardly extending from the base 211 and coaxially arranged with the inner conductor 22 which is essentially located at the circle center, and a plurality of protrusions located around a peripheral region with regard to the corresponding center with regard to the inner conductor 22. The base 211 is diametrically larger than the tubular section 212. The outer conductor 21 forms a hole 23 extending through both the base 211 and the tubular section 212 to receive the inner conductor 22 and the insulator 25 therein. Understandably, the center hole 120 is also dimensioned to receive both the inner conductor 22 and the insulator 25.

The protrusions include a pair of first arc protrusions 2111 and a pair of second arc protrusions 2112 shorter than the first arc protrusion 2111 while being both coaxially arranged with regard to the inner conductor 22 wherein the first arc protrusions 2111 are respectively received within the corresponding first arc holes 121 with clearance while the second arc protrusions 2112 are respectively received within the corresponding second arc holes 122 with an interference it. Understandably, this arrangement provide both rigidity and flexibility for mating and testing. The base 211 further includes a cutout 212 which is used for compliantly receiving a step structure around the corresponding printed circuit board for mounting consideration. Understandably, the rear end of the protrusion is riveted to securely fix the mating unit 2 to the front side wall 12 of the metal box 1. Alternately, the protrusions may be soldered or welded to the front side wall 12 of the metal box 1. Understandably, the dimension of the arc through hole should be not only small enough not to jeopardize the required rigidness of the front side wall 12 but also large enough to allow a relatively large arc protrusion to be received therein for enhancing interengagement between the front side wall 12 of the metal box 1 and the outer conductor 21.

Figure 6:
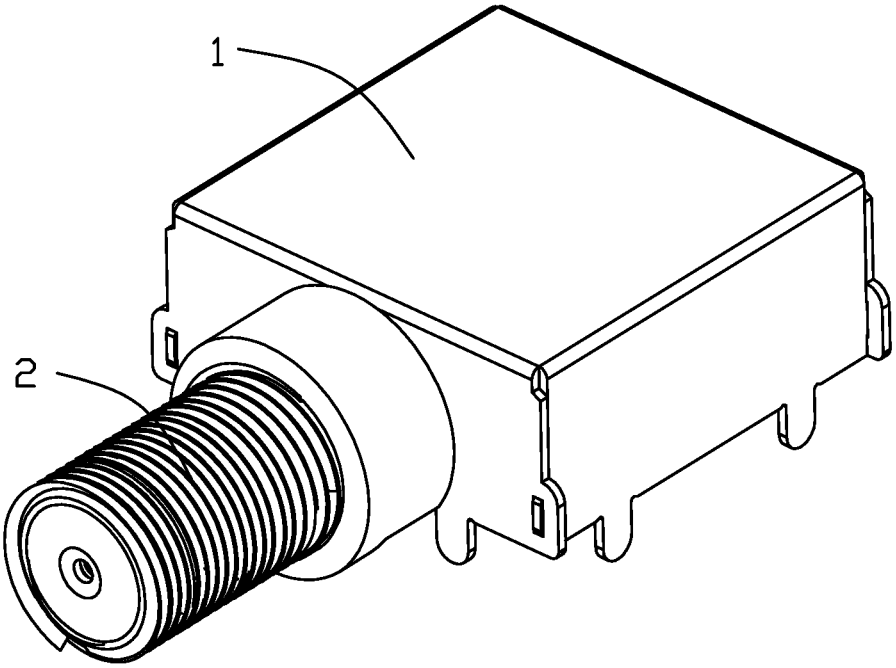
FIG. 6 is a perspective view of the electrical connector according to a second embodiment.
Figure 7:
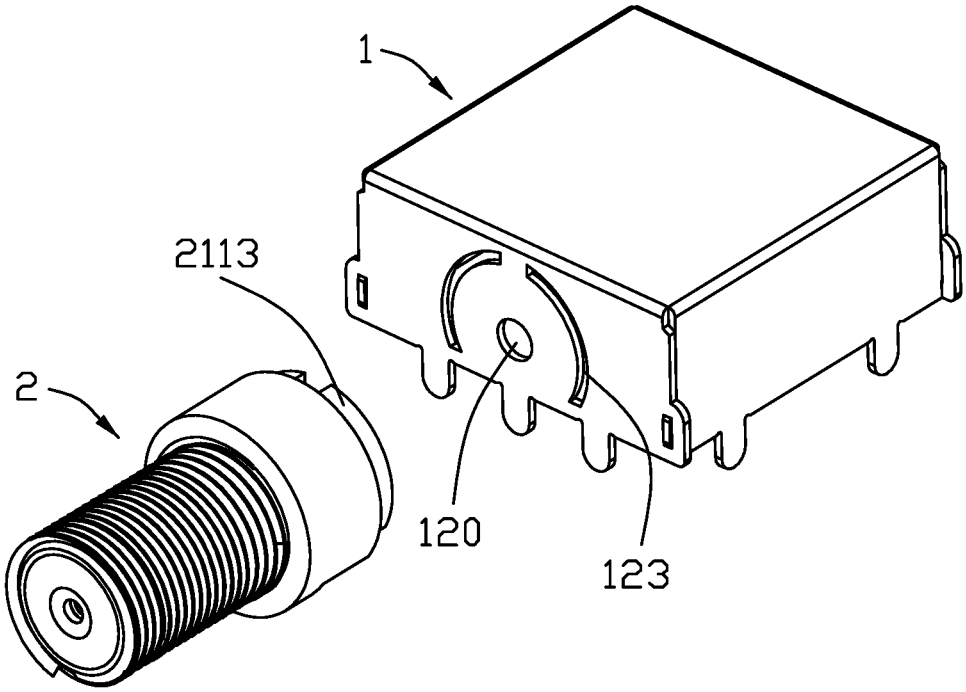
FIG. 7 is an exploded perspective view of the electrical connector of FIG. 6.
Figure 8:
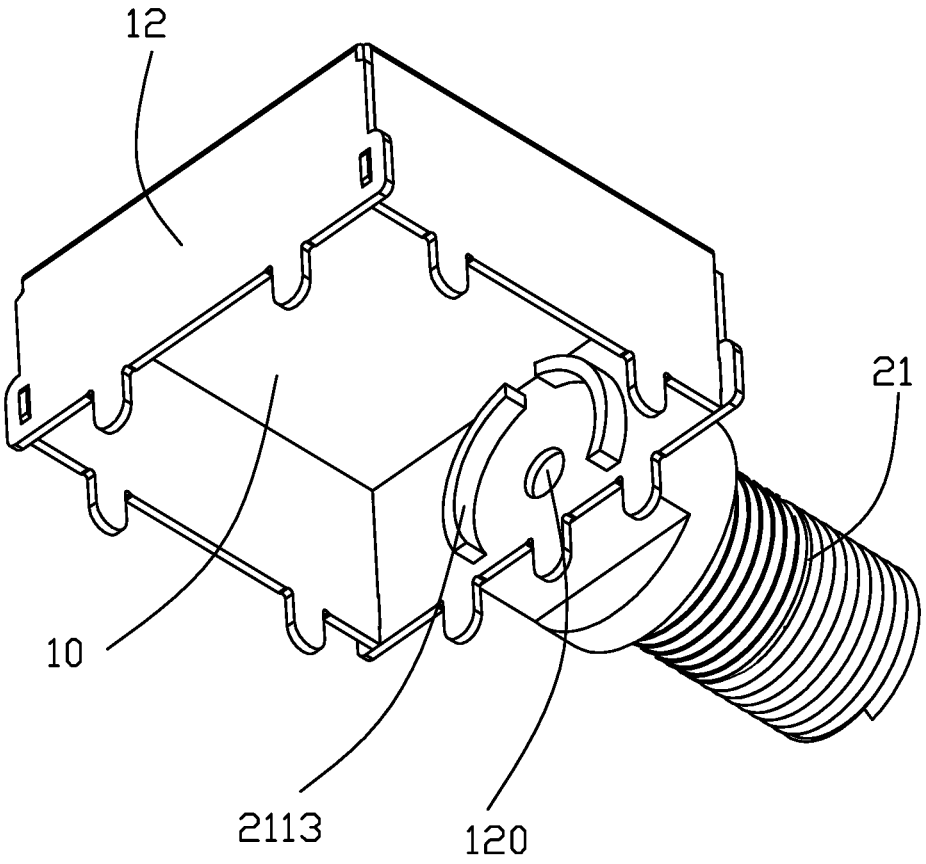
FIG. 8 is another perspective view of the electrical connector of FIG. 6.
Figure 9:
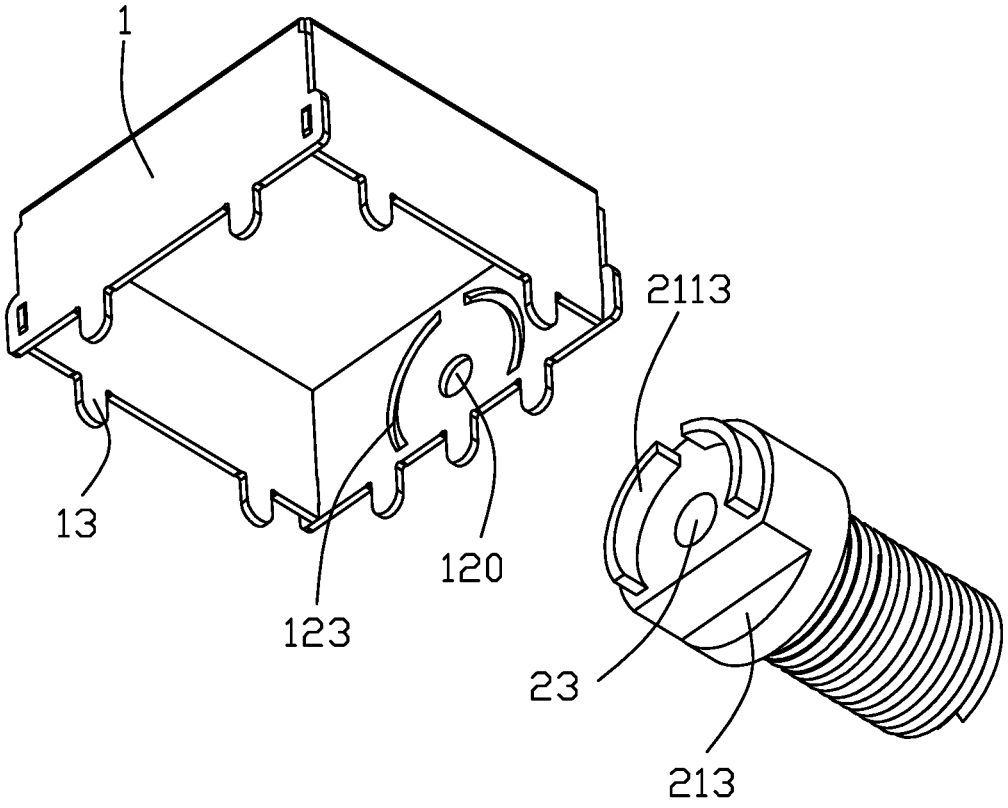
FIG. 9 is another exploded perspective view of the electrical connector of FIG. 7.

Referring to FIGS. 6-9, compared with the first embodiment, the pair of first arc protrusions 2111 and the pair of second arc protrusions 2112 of the first embodiment are joined together to form a pair of third arc protrusions 2113 in the second embodiment, and the corresponding first arc hole 121 and second arc hole 122 are also joined together as the third arc hole 123 to receive the third arc protrusion 2113.

Figure 10:
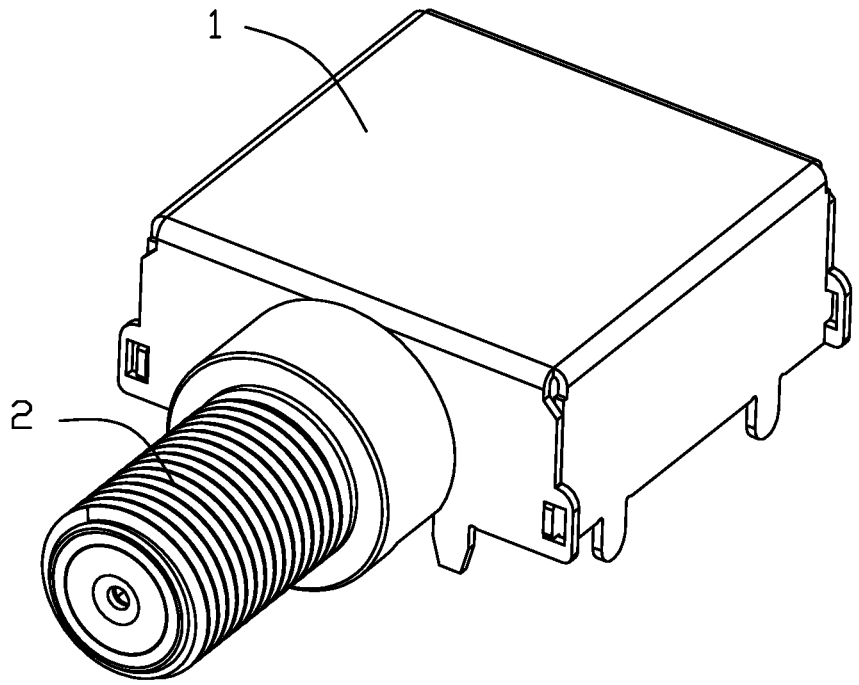
FIG. 10 is a perspective view of the electrical connector of according to a third embodiment of the invention.
Figure 11:
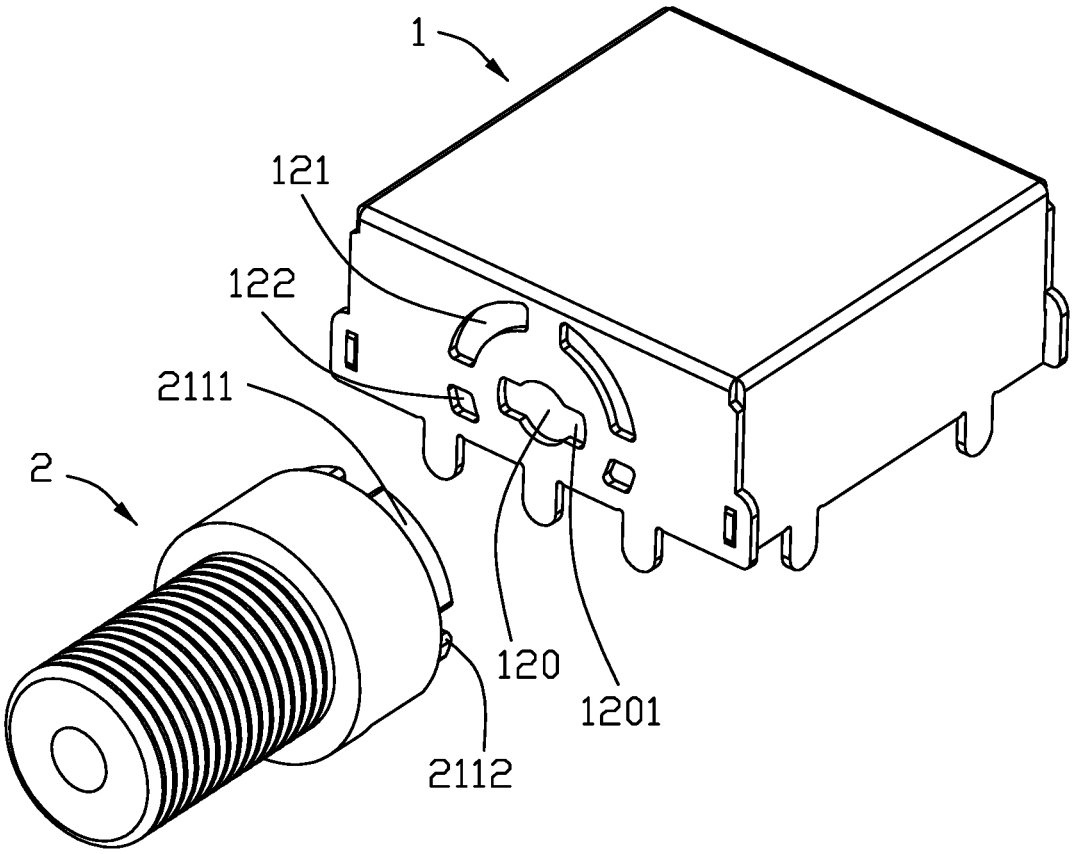
FIG. 11 is an exploded perspective view of the electrical connector of FIG. 10.
Figure 12:
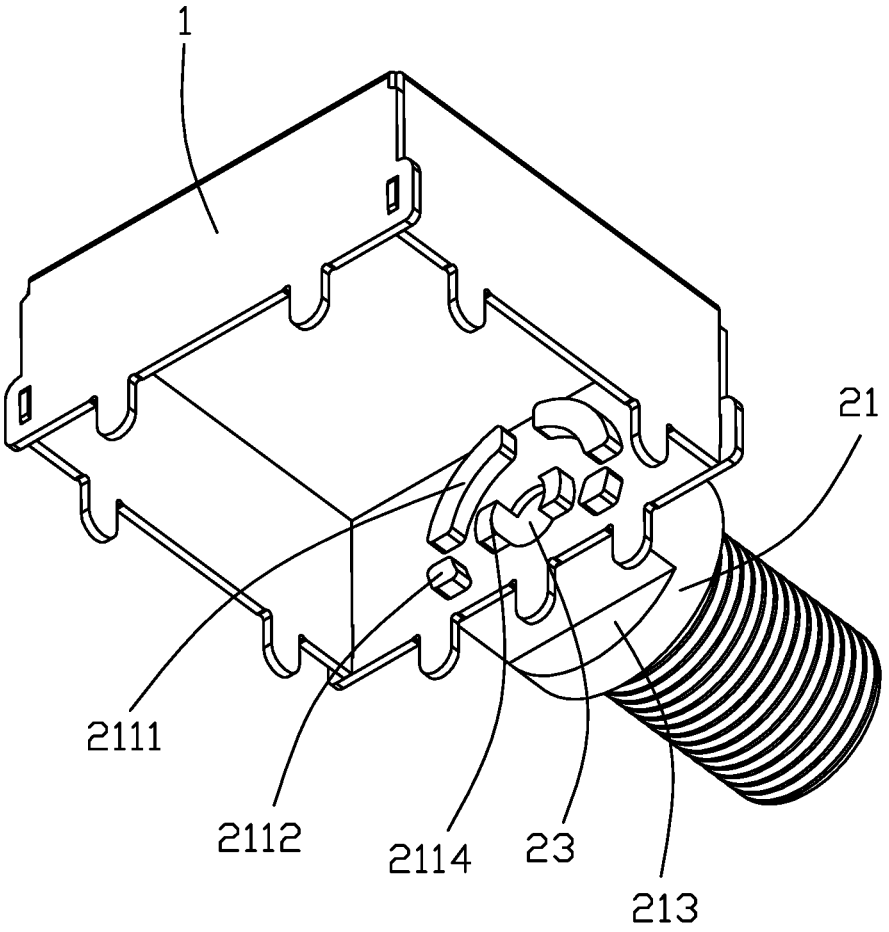
FIG. 12 is another perspective view of the electrical connector of FIG. 10.
Figure 13:
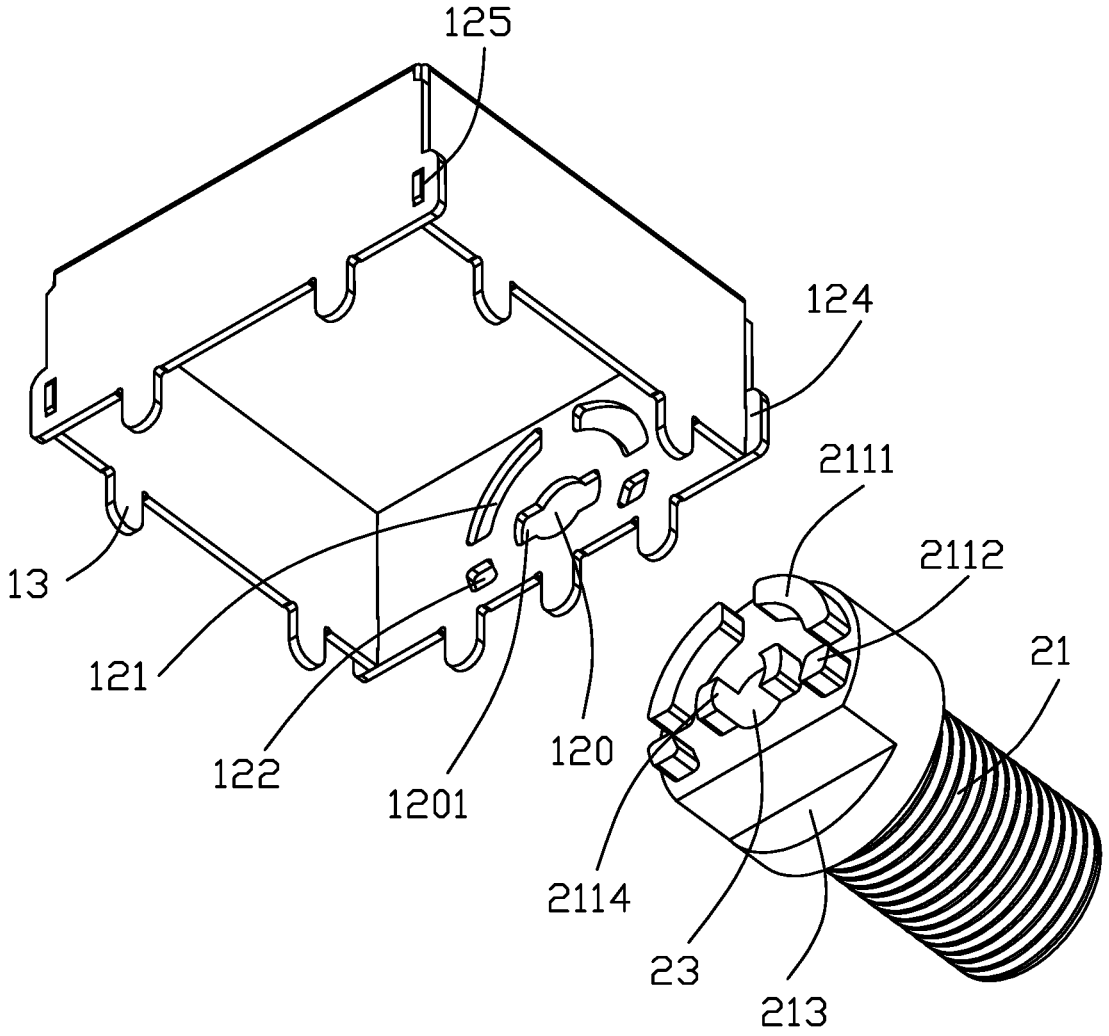
FIG. 13 is another exploded perspective view of the electrical connector of FIG. 11.

Referring to FIGS. 10-13, a pair of fourth protrusions 2114 are formed on the rear face of the base 211 and located around a periphery of the hole 23. Correspondingly, the center hole 120 is enlarged to include a pair of side holes 1201 to receive the pair of fourth protrusions 2114, respectively. The fourth protrusions 2114 may be riveted for enhancing securement between the metal box 1 and the mating unit 2.

While a preferred embodiment in accordance with the present disclosure has been shown and described, equivalent modifications and changes known to persons skilled in the art according to the spirit of the present disclosure are considered within the scope of the present disclosure as described in the appended claims.

What is claimed is:

1. An electrical connector comprising:

a mating unit having a cylindrical contour and including:

a tubular outer conductor having a base and a tubular mating section forwardly extending from the base, and a plurality of arc protrusions formed on a rear face of the base and being coaxially arranged with a center of the outer conductor;

an inner conductor located at said center of the outer conductor;

an insulator located between the inner conductor and the outer conductor to separate the inner conductor and the outer conductor from each other; and a metal box including a front side wall with a plurality of arc through holes and a center hole coaxially arranged with each other; wherein the inner conductor extends through the center hole, and the arc protrusions extend through the corresponding arc through holes in a front-to-back direction and are riveted on a back side of the front side wall; wherein the metal box is made from sheet metal with a top wall and a plurality of sides walls respectively downwardly extending unitarily from corresponding side edges of the top wall and cooperating with the top wall to commonly form a rectangular downwardly facing cavity; wherein the front side wall is one of said side walls; wherein each side wall includes at least one mounting leg downwardly extending from a lower edge thereof.

2. The electrical connector as claimed in claim 1, wherein the arc protrusions are located around a peripheral region of a circle defined by the center of the outer conductor, and the corresponding arc through holes are located around a peripheral region of a circle defined by the center hole.

3. The electrical connector as claimed in claim 1, wherein each arc protrusion extends with more than 90 degrees, and the corresponding through hole extends with more than 90 degrees.

4. The electrical connector as claimed in claim 1, wherein the arc through holes include a long arc hole and a short arc hole located by each side of the center hole, and the arc protrusions include a large arc protrusion and a small arc protrusion on each said of the inner conductor.

5. The electrical connector as claimed in claim 4, wherein the long arc hole receives the corresponding large protrusion with clearance while the short arc hole receives the corresponding small protrusion with an interference fit.

6. The electrical connector as claimed in claim 4, wherein the long arc hole is higher than the center hole, and the small arc hole is lower than the center hole.

7. The electrical connector as claimed in claim 3, wherein the arc protrusion is not interrupted.

8. The electrical connector as claimed in claim 1, wherein the outer conductor further includes a pair of protrusions formed on the rear face and adjacent to the inner conductor, and the front side wall further includes a pair of expansion holes communicatively by two sides of the center hole to receiving said pair of protrusions.

9. The electrical connector as claimed in claim 1, wherein the center hole is located at a lower portion of the front side wall.

10. The electrical connector as claimed in claim 1, wherein both the insulator and the inner conductor are received within the center hole.

11. An electrical connector comprising:

a mating unit having a cylindrical contour and including:

a tubular outer conductor having a base and a tubular mating section forwardly extending from the base, and a plurality of arc protrusions formed on a rear face of the base and being coaxially arranged with a center of the outer conductor;

an inner conductor located at said center of the outer conductor;

an insulator located between the inner conductor and the outer conductor to separate the inner conductor and the outer conductor from each other; and a metal box including a front side wall with a plurality of arc through holes and a center hole coaxially arranged with each other; wherein the inner conductor extends through the center hole, and the arc protrusions extend through the corresponding arc through holes in a front-to-back direction and are fastened thereto; wherein the metal box is made from sheet metal with a top wall and a plurality of sides walls respectively downwardly extending unitarily from corresponding side edges of the top wall and cooperating with the top wall to commonly form a rectangular downwardly facing cavity; wherein the front side wall is one of said side walls; wherein each side wall includes at least one mounting leg downwardly extending from a lower edge thereof.

12. The electrical connector as claimed in claim 11, wherein the arc protrusions are located around a peripheral region of a circle defined by the center of the outer conductor, and the corresponding arc through holes are located around a peripheral region of a circle defined by the center hole.

13. The electrical connector as claimed in claim 11, wherein each arc protrusion extends with more than 90 degrees, and the corresponding through hole extends with more than 90 degrees.

14. The electrical connector as claimed in claim 11, wherein the arc through holes include a long arc hole and a short arc hole located by each side of the center hole, and the arc protrusions include a large arc protrusion and a small arc protrusion on each said of the inner conductor.

15. The electrical connector as claimed in claim 14, wherein the long arc hole receives the corresponding large protrusion with clearance while the short arc hole receives the corresponding small protrusion with an interference fit.

16. The electrical connector as claimed in claim 14, wherein the long arc hole is higher than the center hole, and the small arc hole is lower than the center hole.

17. The electrical connector as claimed in claim 13, wherein the arc protrusion is not interrupted.

18. The electrical connector as claimed in claim 11, wherein the outer conductor further includes a pair of protrusions formed on the rear face and adjacent to the inner conductor, and the front side wall further includes a pair of expansion holes communicatively by two sides of the center hole to receiving said pair of protrusions.

19. The electrical connector as claimed in claim 11, wherein the center hole is located at a lower portion of the front side wall.

* * * * *